US006019156A

United States Patent [19]

Wagner et al.

[11] Patent Number: 6,019,156

[45] **Date of Patent: *Feb. 1, 2000**

[54] ROLL-UP DOOR

[75] Inventors: Donald A. Wagner, Germantown; Tim Hornberger, Green Bay, both of Wis.

[73] Assignee: Kelley Company, Inc., Mequon, Wis.

[ * ] Notice: This patent is subject to a terminal disclaimer.

[21] Appl. No.: 09/072,844

[22] Filed: May 5, 1998

Related U.S. Application Data

[63] Continuation of application No. 08/647,353, May 9, 1996, Pat. No. 5,758,705.

[51] Int. Cl.[7] ..... E06B 9/56

[52] U.S. Cl. ..... 160/310; 160/190

[58] Field of Search ..... 160/310, 265, 160/8, 1, 133, 189, 190, 193, 322, 273.1, 271, 311, 312, 405

[56] References Cited

U.S. PATENT DOCUMENTS

| | | | |
|---|---|---|---|
| 66,995 | 7/1867 | Smith . | |
| 1,579,677 | 4/1926 | Tomkinson . | |
| 1,682,772 | 9/1928 | Cahill . | |
| 1,994,785 | 3/1935 | Premo . | |
| 2,413,471 | 12/1946 | Sorrentino | 160/133 |
| 3,583,465 | 6/1971 | Young . | |
| 3,981,343 | 9/1976 | DeVito . | |
| 4,037,526 | 7/1977 | Jackle . | |
| 4,727,919 | 3/1988 | Kraeutler . | |
| 4,974,658 | 12/1990 | Komatsu et al. . | |
| 4,976,302 | 12/1990 | Taylor . | |
| 4,997,022 | 3/1991 | Klein . | |
| 5,025,847 | 6/1991 | Mueller . | |
| 5,048,588 | 9/1991 | Weishar et al. . | |
| 5,088,543 | 2/1992 | Bilbrey | 160/265 X |
| 5,129,442 | 7/1992 | Warner . | |
| 5,137,075 | 8/1992 | Desrochers . | |
| 5,139,074 | 8/1992 | Warner . | |
| 5,141,044 | 8/1992 | Hying et al. . | |
| 5,159,967 | 11/1992 | Ashley et al. . | |
| 5,170,833 | 12/1992 | Taylor et al. . | |
| 5,203,392 | 4/1993 | Shea . | |
| 5,205,070 | 4/1993 | Lundstrom . | |
| 5,222,541 | 6/1993 | Hornberger . | |
| 5,271,448 | 12/1993 | Delgado . | |
| 5,353,859 | 10/1994 | Oltahfer et al. . | |

FOREIGN PATENT DOCUMENTS

| | | |
|---|---|---|
| 251907 | 5/1964 | Australia . |

*Primary Examiner*—David M. Purol
*Attorney, Agent, or Firm*—Michael Best & Freidrich LLP

[57] ABSTRACT

An overhead door including a door panel vertically movable between a lowered position when the door is closed and a raised position when the door is open, and a motor drivingly connected to a lower end of the door panel to selectively drive the lower end of the door panel downwardly. The motor is drivingly connected to the lower end of the door panel to drive the door panel downwardly in response to actuation of the motor. Preferably, the connection includes a flexible drive element (e.g., an endless belt) driven by the motor and connected to the lower end of the door panel. A pivot member releasably connects the door panel to the guide member, and is pivotable relative to at least one of the door panel or the guide member in response to a force on the door panel. The pivot member includes a first pivot segment pivotally connected to the door panel and a second pivot segment pivotally connected to the guide member, the first and second pivot segments releasably engaging each other.

10 Claims, 5 Drawing Sheets

ROLL-UP DOOR

This application is a continuation of U.S. application Ser. No. 08/647,353, filed May 9, 1996, U.S. Pat. No. 5,758,705.

FIELD OF THE INVENTION

The present invention generally relates to the field of roll-up doors for industrial doorways, such as are found in warehouses. More specifically, the present invention relates to roll-up doors with bottom beams that separate from a track when contacted by an excessive lateral force.

BACKGROUND OF THE INVENTION

Roll-up doors are commonly used to close openings, such as large doorways. For example, roll-up doors have been used to provide barriers between separate rooms of a warehouse or to provide closures for dock openings. Roll-up doors provide a closure mechanism that can be opened and closed to allow for passage of people or vehicles through the opening. Because of their high-speed operation, roll-up doors are particularly preferred when high-speed vehicles, such as forklifts, will be passing through the opening.

Roll-up doors typically include a roll of material positioned above a doorway, and a bottom beam secured to the free end of the material. The bottom beam is typically biased downwardly (e.g., using cables, pulleys and weights or springs) to keep the material under tension and to assist in unwinding of the roll. The roll is driven by a motor that selectively unwinds and winds the roll to close and open the doorway, respectively.

Recently, roll-up doors have been designed so that the bottom beam will break away upon impact by a force above a predetermined limit. Such a design limits damage to the assembly in the event that a vehicle (e.g., a forklift) inadvertently collides with the bottom beam. The breakaway feature is accomplished by detachably connecting both ends of the bottom beam to respective guide members (e.g., called "tension arms") that are at least partially hidden within vertical tracks along the doorway jambs. For example, the bottom beam can have a transverse opening in each end of the beam (i.e., extending through the plane of the beam) that receive pegs extending from the guide members. The pegs are releasably held within the transverse openings by a corresponding detent mechanism, and the guide members are biased downwardly to provide tension to the material. Upon being impacted by a sufficient force, the beam will break away from the pegs, thereby reducing the likelihood of damaging the assembly.

Roll-up doors can further include a mechanism for biasing the roll in the winding direction (i.e. biasing the door upward) to at least partially counteract the weight of the unwound material to thereby assist the motor in winding the roll. In addition, roll-up doors can further include retention straps secured to the guide members and wrapped around the roll to prevent the guide members from slamming to the ground when the bottom beam breaks away from the guide members.

The above-described types of roll-up doors have performed satisfactorily under a variety of circumstances. However, there has been a need for simpler, less costly and more reliable roll-up doors.

SUMMARY OF THE INVENTION

In one aspect, the present invention provides an overhead door that eliminates the need to provide weighted tensioning mechanisms for pulling down on the bottom beam, and further eliminates the need for retention straps for preventing the guide members from slamming down when the bottom beam releases. In this aspect, the overhead door comprises a door panel vertically movable between a lowered position when the door is closed and a raised position when the door is open, and a motor drivingly connected to a lower end of the door panel to selectively drive the lower end of the door panel downwardly. For example, the door panel can include a flexible panel adapted to be wound onto a roll member when the door is open and unwound from the roll member when the door is closed, and a bottom member connected to a free end of the flexible panel and forming the lower end of the door panel. In addition, the overhead door preferably includes means for counteracting the weights of the flexible panel and the bottom member, such as a biasing weight connected to the roll member to rotatably bias the roll member to rotate in a winding direction (e.g., upwardly).

In one embodiment, the overhead door further comprises means for drivingly connecting the motor to the lower end of the door panel to drive the door panel downwardly in response to actuation of the motor. Preferably, the connecting means comprises a flexible drive element (e.g., an endless belt) driven by the motor and connected to the lower end of the door panel. For example, the flexible drive element could follow a circuitous path that extends downwardly from the lower end of the door panel, upwardly above the lower end, then downwardly to the lower end to thereby form a loop drive system.

The above-described embodiment facilitates the provision of extra tension to the flexible panel when needed (e.g., during high winds). This is accomplished by moving the flexible panel from the open position to the closed position, limiting motion of the upper end of the flexible panel, and increasing a downward force on the lower end of the flexible panel to thereby increase tension in the flexible panel (e.g., by actuating a motor drivingly connected to the lower end). For example, when the flexible panel is secured to a rotatable roll member, the limiting step can include the step of inhibiting rotation of the roll member (e.g., by actuating a shaft brake mechanism).

In another aspect, the present invention provides an overhead door comprising a generally vertically-extending track, a guide member vertically movable along the track, and a door panel vertically movable relative to the track between a lowered position when the door is closed and a raised position when the door is open. A pivot member releasably connects the door panel to the guide member, and is pivotable relative to at least one of the door panel or the guide member in response to a force on the door panel. The pivot member is pivotable between an engaged position, where the door panel is engagable with the guide member, and a released position, where the door panel is releasable from the guide member. For example, the pivot member can be pivotally mounted using a removable pivot pin to facilitate reattachment of the door panel to the guide member, as described below in more detail.

In one embodiment, the door panel includes a flexible panel adapted to be wound onto a roll member when the door is open and unwound from the roll member when the door is closed, and a bottom member connected to a free end of the flexible panel. The motor is drivingly connected to the bottom member. In another embodiment, the pivot member includes a first pivot segment pivotally connected to the door panel and a second pivot segment pivotally connected to the guide member, the first and second pivot segments releasably engaging each other. For example, one of the first and second pivot segments can include a pocket, and the other of the first and second pivot segments can be slidably positionable within the pocket. Preferably, the first pivot segment is biased (e.g., using a torsion spring) relative to the door panel into the engaged position, whereas the second pivot segment is freely pivotable relative to the guide member.

DETAILED DESCRIPTION

Figure 1:
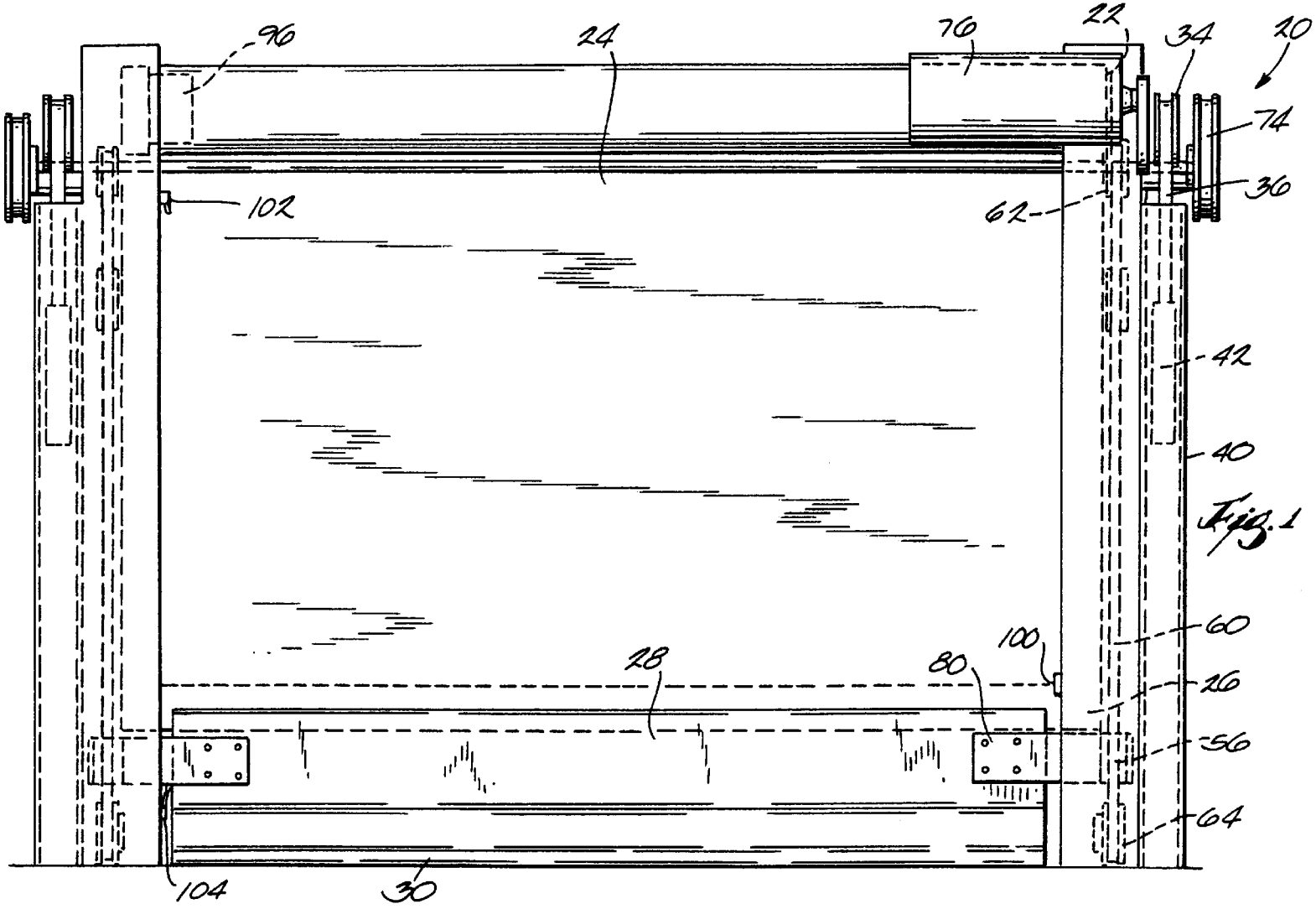
FIG. 1 is a front view of a roll-up door assembly embodying the present invention.
Figure 2:
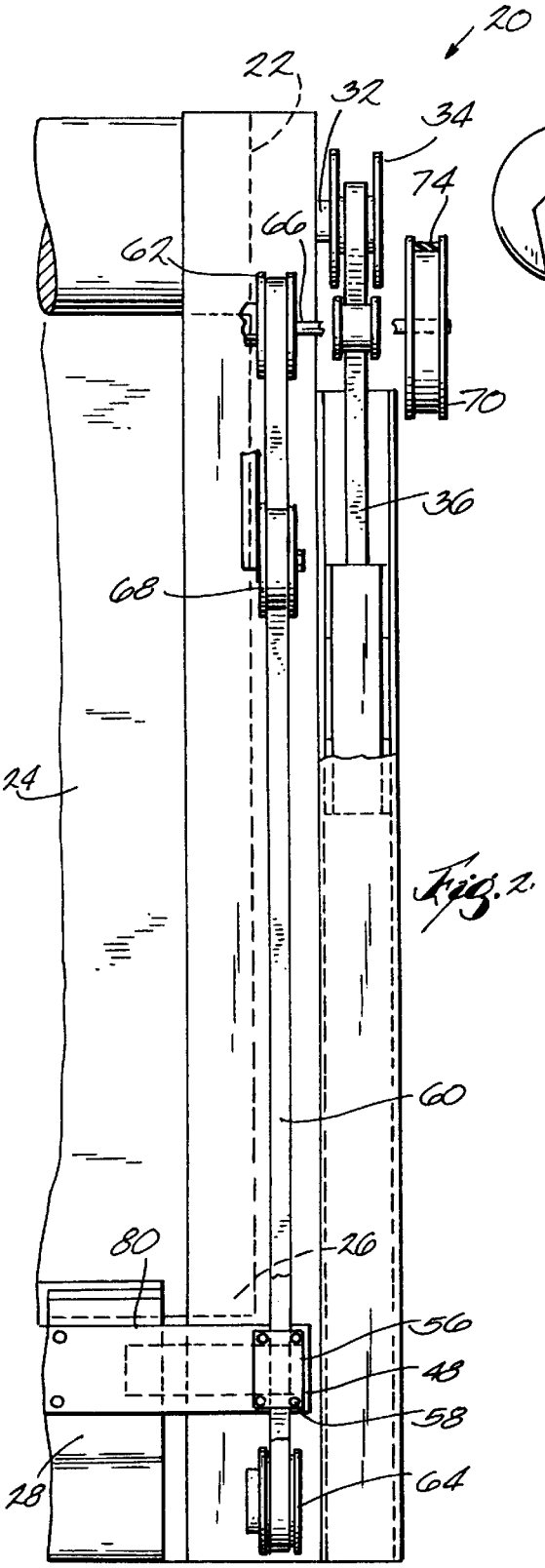
FIG. 2 is an enlarged partial front view of the assembly illustrated in FIG. 1.

FIGS. 1–12 illustrate an overhead door embodying the present invention. Referring specifically to FIG. 1, the illustrated overhead door comprises a roll-up door assembly 20 generally including a longitudinally-extending cylindrical roll member 22 that can be rotatably mounted above a doorway (not shown). A flexible panel 24 is partially wrapped around the roll member 22 and extends downwardly from the roll member 22 to terminate at a free end 26. In the described embodiment, the flexible panel 24 comprises PVC-coated polyester fabric, available as part no. G-438 2-ply SBS from Globe International, Inc. of Buffalo, N.Y. A bottom beam in the form of a bottom member 28 is secured to the free end 26 of the flexible panel 24. The bottom member 28 comprises a substantially rigid beam structure that extends across substantially the entire width of the flexible panel 24. In the described embodiment, the bottom member 28 is an aluminum extrusion having a rubber member 30 secured to a lowered end thereof.

The above-described assembly 20 is designed to be positioned adjacent to a doorway so that winding and unwinding of the roll member 22 results in raising and lowering of the bottom member 28 and panel to thereby open and close the doorway. The manner in which the flexible panel 24 is raised and lowered is an inventive feature of the present invention. In this regard, except as otherwise noted below, each side of the illustrated assembly 20 includes substantially identical mechanisms for raising and lowering the panel. Accordingly, only one side will be described below.

Figure 3:
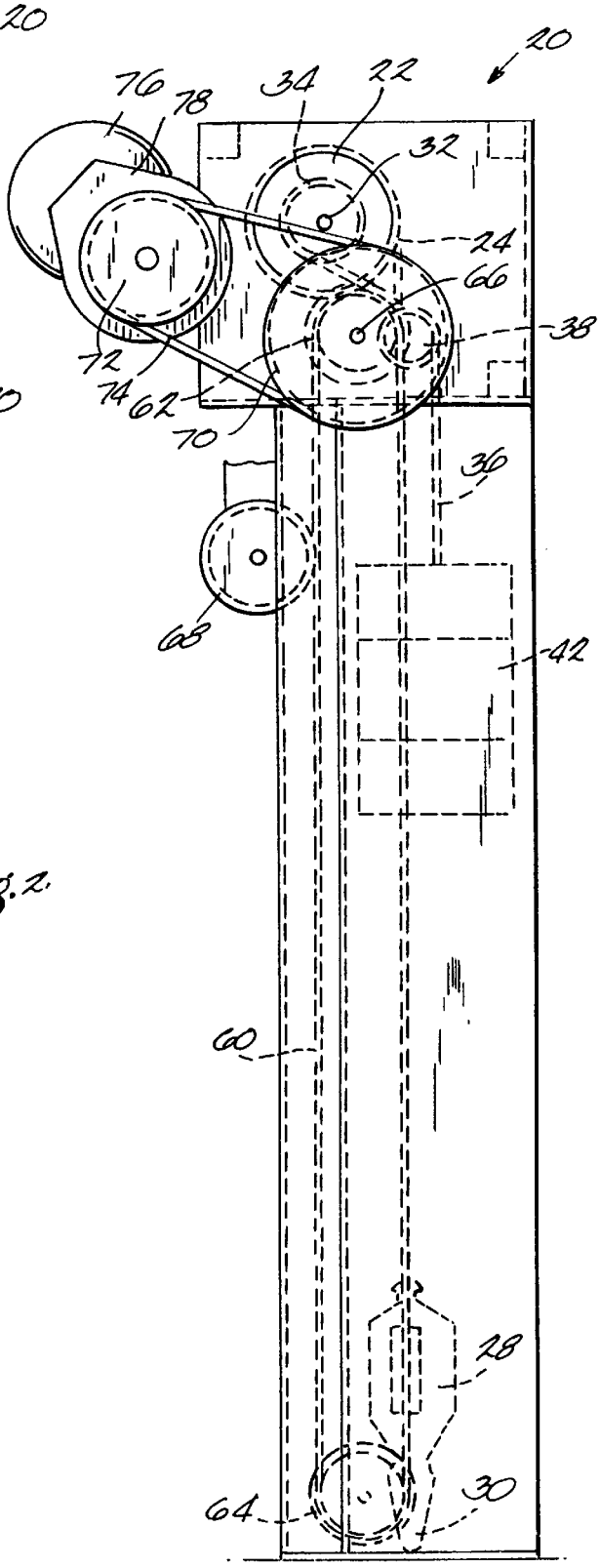
FIG. 3 is a side view of the assembly illustrated in FIG. 2.
Figure 4:
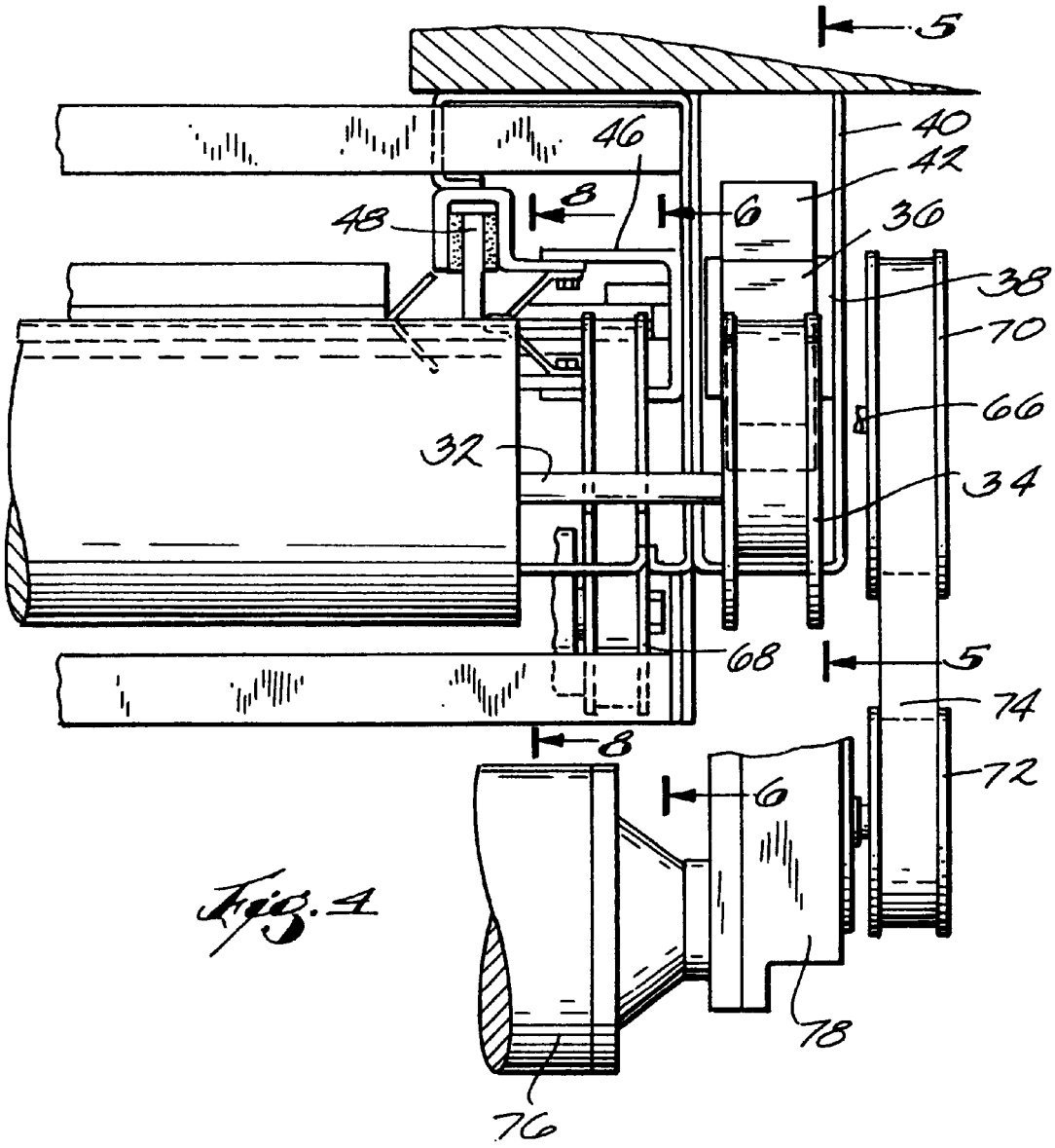
FIG. 4 is a partial top view of the assembly illustrated in FIG. 2.
Figures 5, 6, 7, 8:
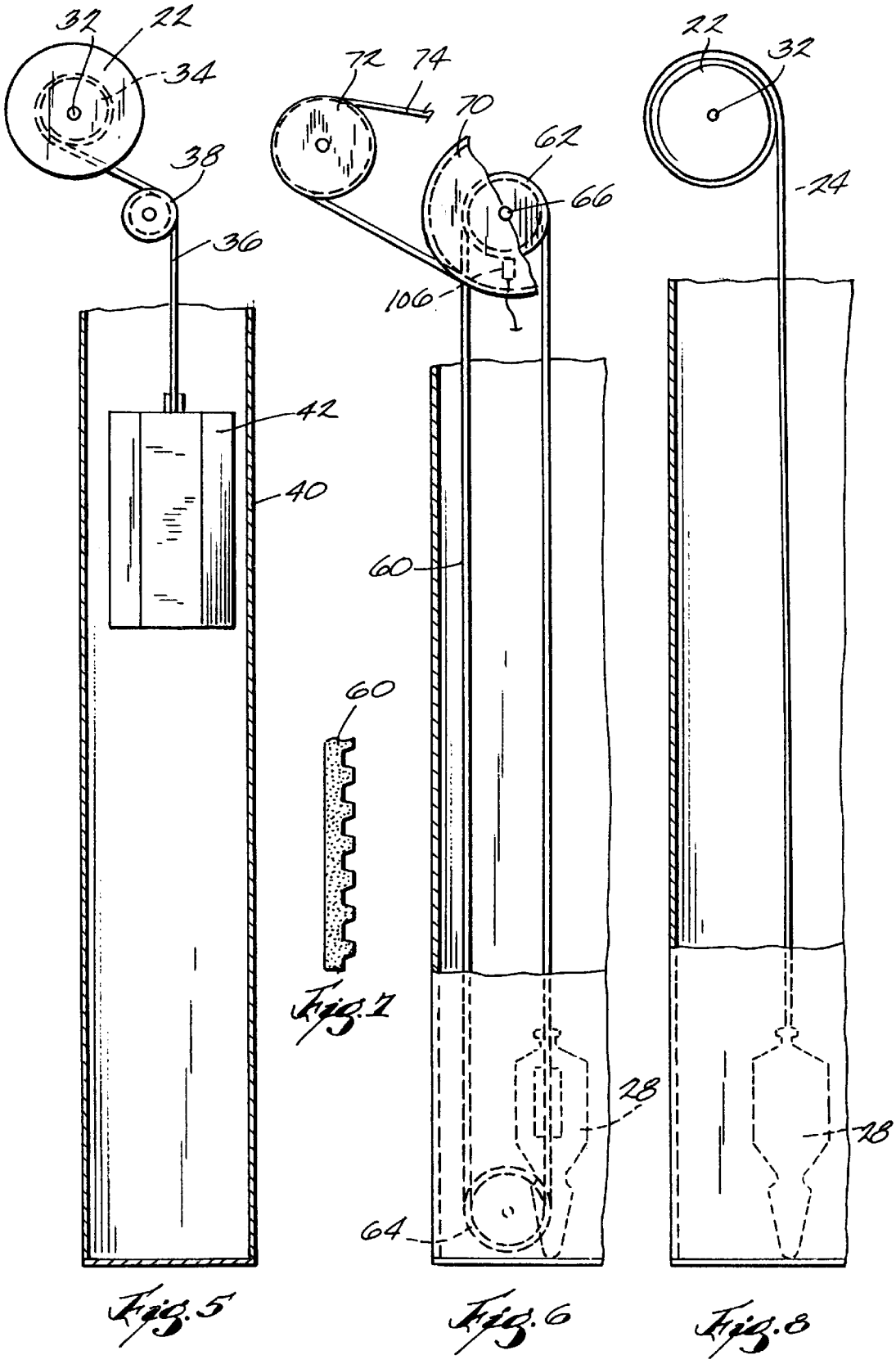
FIG. 5 is a partial side section view taken along line 5—5 in FIG. 4.
FIG. 6 is a partial side section view taken along line 6—6 in FIG. 4.
FIG. 7 is an enlarged partial side view of the flexible drive element illustrated in FIG. 6.
FIG. 8 is a partial side section view taken along line 8—8 in FIG. 4.

Referring now to FIGS. 1–8, the assembly 20 includes a means for counteracting the weight of the panel and bottom member 28. For example, in the illustrated embodiment, the counteracting means can include means for rotatably biasing the roll member 22 in a winding direction that winds the panel onto the roll member 22. The illustrated biasing means includes a roll shaft 32 extending from the end of the roll member 22 and designed to rotate with the roll member 22. A winding pulley 34 is secured to the end of the roll shaft 32 so that rotation of the roll member 22 results in rotation of the winding pulley 34. A strap 36 is wound around the winding pulley 34 and then travels around an idler pulley 38 and down into a hollow column 40 where it is secured to a biasing weight 42. In the illustrated embodiment, the strap 36 comprises part no. ENI-5P from Habasit Belting Incorporated of Atlanta, Ga. The combination of the winding pulley 34, the strap 36, the idler pulley 38 and the biasing weight 42 biases the roll member 22 in a counter clockwise direction, as illustrated in FIG. 3, corresponding with a winding direction (i.e., wherein the flexible panel 24 is wound onto the roll member 22). It should be appreciated that the weight 42 could be replaced by any suitable biasing device, such as a spring.

In the illustrated embodiment, the weight 42 is chosen so that it compensates for the weight of the panel and the bottom member 28 when the bottom member 28 is at its lowest position (i.e., when the door is closed). Therefore, when the bottom member 28 is closed, there is little or no biasing force tending to raise or lower the bottom member 28. The amount of torque provided by the weight 42 will vary depending on the size and weight of the panel and bottom member 28. It should be appreciated that the weight 42 could instead be chosen such that there is an upward biasing force on the panel 24 when the door is closed, thereby providing tension to the panel 24.

The present invention raises and lowers the panel by driving the bottom member 28. That is, the position of the bottom member 28 is directly controlled by a drive means. In the illustrated embodiment, such drive means includes a loop drive system. Referring to FIGS. 6–10, the loop drive system generally comprises a vertically-extending track 46 positioned adjacent the side of the flexible panel 24. A guide member 48 is slidably positioned within the track 46 and is designed to provide guidance to the bottom member 28. The track 46 includes three parallel guideways 50 that slidably receive three rigidly-interconnected flanges 52 of the guide member 48. Guide plates 54 on the guide member 48 provide an interface between the flanges 52 and the track 46.

The guide member 48 is secured by a plate 56 and fasteners 58 to a flexible drive element 60 that passes around an upper pulley 62 and a lower pulley 64 to form an endless belt. The upper pulley 62 is secured to a rotatably mounted drive shaft 66. A rotary tensioner 68 is biased into engagement with the flexible drive element 60 to maintain an appropriate tension in the drive element 60. In the illustrated embodiment, the flexible drive element 60 is a toothed belt available as timing belt part no. H.500P x 1W from Mectrol Corporation of Salem, N.H., and the pulleys are toothed pulleys available as part no. 36H100 1-1/4 bore from TB Woods Sons Company of Chambersburg, Pa. In the illustrated embodiment, the rotary tensioner 68 comprises part no. RT2001 from Efson of Wilmington, N.C.

On only one side of the assembly 20, a first drive pulley 70 is secured to one end of the drive shaft 66, as best shown in FIGS. 1–6. The first drive pulley 70 is driven by a second drive pulley 72 via a drive belt 74. The second drive pulley 72 is driven by an electric motor 76 through an appropriate gear box 78. Actuation of the electric motor 76 will result in rotation of the drive shaft 66, which drives the upper pulleys 62 on both sides of the assembly 20. Rotation of the upper pulleys 62 causes movement of the flexible drive elements 60, and corresponding vertical movement of the guide members 48. Movement of the guide members 48 results in movement of the bottom member 28 and corresponding movement of the panel 24. Because of the balanced design of the weight 42 against the panel 24 and the bottom member 28, the electric motor 76 only needs to lift the weight of the bottom member 28, and the weight 42 will effectively roll the panel 24 upwardly onto the roll member 22. The motor is an AC motor with variable frequency capabilities, thereby providing means for varying the speed of the motor. In the illustrated embodiment, the electric motor 76 comprises a Leeson 2 HP TEFV 1750 RPM Motor available from Leeson Electric Corporation of Grafton, Wis.

Referring to FIGS. 9–12, the bottom member 28 is releasably interconnected with the guide member 48 through a pivot member including a first pivotable segment 80 secured to the bottom member 28 and a second pivot segment 82 secured firs the guide member 48. The first pivot segment 80 includes upper and lower bearings 84 that allow the first pivot segment 80 to rotate relative to a central hexagonal shaft 86. The upper and lower ends of the shaft are secured to a yoke assembly 88 secured to the bottom member 28. A spring member 90 in the form of a torsion spring is interconnected between the hexagonal shaft 86 and the first pivot segment 80 such that the first pivot segment 80 is biased into alignment with the bottom member 28. In the illustrated embodiment, the spring member 90 comprises two elastomeric torsion springs positioned in series. The springs are chosen to produce a torque of about 300 in-lb at 50 degrees rotation. Such elastomeric torsion springs can be obtained from B.F.Goodrich under the trademark TORSI-LASTIC. The first pivot segment 80 includes a pocket 92 for insertably receiving the second pivot segment 82. The second pivot segment 82 is freely pivotally pinned to the guide member 48 utilizing a removable pin 94.

It should be appreciated that the spring member could act upon the second pivot segment instead of or in addition to the first pivot segment. In addition, the pocket could be formed in the second pivot segment instead of the first pivot segment, if desired.

The above-described interaction between the first and second pivot segments provide a releasable interconnection between the bottom member 28 and the guide member 48. More specifically, with the second pivot segment 82 positioned within the pocket 92 of the first pivot segment 80, the bottom member 28 will be held in place due to the biasing of the first pivot segment 80 into alignment with the bottom member 28. When the bottom member 28 is subjected to a transverse force having a horizontal component, the bottom member 28 will move horizontally, and the first pivot segment 80 will rotate. Such movement and rotation results in the first pivot segment 80 pulling away from the second pivot segment 82. If the transverse force stays below a predetermined magnitude, removal of the force will result in the first pivot segment 80 springing back to its initial position and returning to full engagement with the second pivot segment 82. If the force exceeds the predetermined magnitude, the first pivot segment 80 will separate from the second pivot segment 82, thereby separating the bottom member 28 from the guide member 48.

After separation, the first pivot segment 80 will immediately return to its initial position (i.e., in alignment with the bottom member 28). Reattachment of the bottom member 28 is accomplished by removing the removable pin 94 that supports the second pivot segment 82, and removing the corresponding second pivot segment 82. The bottom member 28 can then be engaged with the removed second pivot segment 82, and the removed second pivot segment 82 can be slid transversely into the corresponding guide member 48 and pinned in place.

Figure 9:
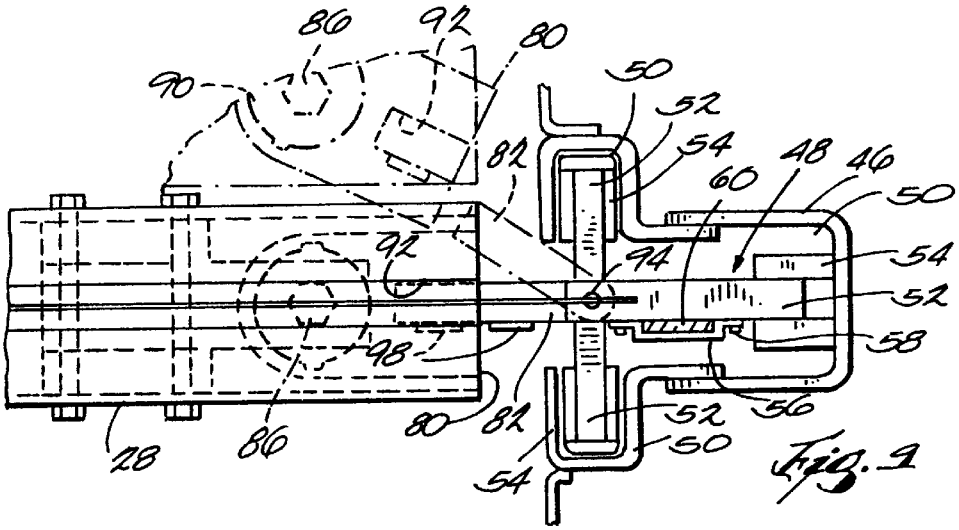
FIG. 9 is an enlarged top view of the guide member and bottom member.
Figure 10:
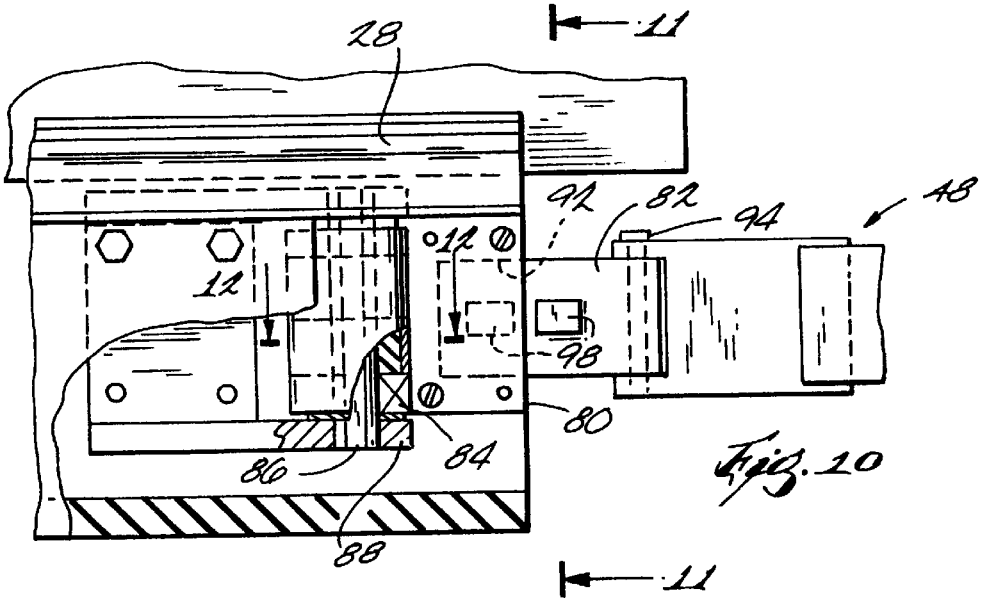
FIG. 10 is an enlarged front view of the guide member and the bottom member.
Figure 11:
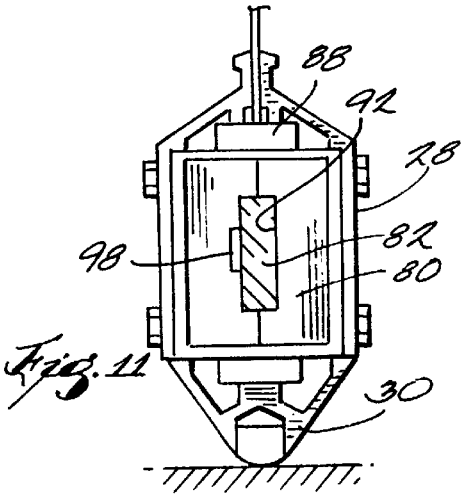
FIG. 11 is a section view taken along line 11—11 in FIG. 10.
Figure 12:
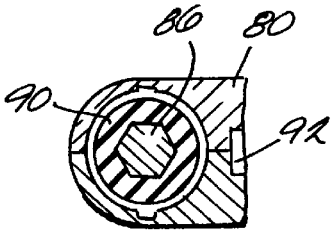
FIG. 12 is a partial section view taken along line 12—12 in FIG. 10.

The illustrated assembly 20 further includes a means for preventing the panel from winding completely up (i.e., due to the biasing weight 42) upon separation of the bottom member 28 from the guide members 48. The preventing means includes an electronic brake mechanism 96 (shown schematically in FIG. 1) positioned to selectively prevent rotation of the roll member 22. The brake mechanism 96 is operatively interconnected with electronic sensors 98 (FIGS. 9–11) positioned on the first and second pivot segments. The electronics are configured so that the brake mechanism 96 is released when the electronic sensors 98 are adjacent to each other (i.e., when the second pivot segment 82 is inserted into the pocket 92 of the first pivot segment 80, as shown in FIG. 9), thereby allowing unrestricted rotation of the roll member 22. The brake will engage when the electronic sensors are separated (i.e., when the second pivot segment 82 releases from the first pivot segment 80, as shown in dashed lines in FIG. 9), thereby preventing further rotation of the roll member 22. The described brake comprises a SAB 3.2 shaft brake available from J.F. Shotton Company, Inc. of Minneapolis, Minn., and the described electronic sensors 98 comprise 124-IU-22J sensor from Sentrol Incorporated of Portland, Oreg.

In addition to the above-described braking function, the brake mechanism 96 can also be used in conjunction with the electric motor 76 to provide additional tension (i.e., in addition to the tension provided by the biasing weight 42) to the flexible panel 24. This is accomplished by actuating the brake mechanism 96 when the panel is unwound (i.e. doorway in closed), and using the motor to pull down on the bottom member 28 until the desired tension in the panel is achieved. This feature is particularly useful when high winds are acting on the panel.

The illustrated assembly 20 further includes a photo-electric eye mechanism 100 (FIG. 1) positioned near a bottom of the assembly 20. The photo-electric eye can detect the presence of an object in the path of the panel. The photo-electric eye is operatively interconnected with the electric motor 76 such that the motor will prevent closing of the panel 24. For example, if the panel is fully raised, the photo-electric eye 100 will prevent lowering of the panel 24. If the panel 24 is in the process of being lowered, the photo-electric eye 100 will stop the downward movement of the panel 100 and will cause the panel 100 to be raised to its fully open position.

Upper and lower limit switches 102,104 (FIG. 1) are used to limit the range of motion of the bottom member 28. The limit switches 102,104 stop motion of the beam when they are actuated. In addition, the assembly 20 includes means for gradually slowing the motion of the bottom member 28 as the limit switches 102,104 are approached. In the illustrated embodiment, such slowing means comprises a proximity sensor 106 (FIG. 6) operatively positioned near the upper pulley 62. The proximity sensor 106 counts the teeth on the upper pulley 62 to provide an indication of where the bottom member 28 is relative to the closed (or open) position. The proximity sensor 106 can be operatively associated with a motor controller to slow down the motor (i.e., and the speed of the bottom member 28) as the bottom member 28 approaches the limit switches 102,104. In the illustrated embodiment, the limit switches 102,104 are Siemens 3SE3200-1U from Siemens Energy and Automation Incorporated—Controls Division of Alpharetta, Ga., and the proximity sensor is an Efector IF5843 from Efector, Inc. of Itaska, Ill.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. An overhead door comprising:

a roll member;

a door panel rolled onto said roll member such that said door panel is vertically movable between a lowered position when the door is closed and a raised position when the door is open, said door panel having a lower end;

a motor drivingly connected to said lower end of said door panel to selectively drive said lower end of said door panel downwardly, said roll being free from a driving interconnection with said motor for movement toward said raised position; and means for drivingly connecting said motor to said lower end of said door panel to drive said door panel downwardly in response to actuation of said motor;

wherein said connecting means comprises a flexible drive element driven by said motor and connected to said lower end of said door panel, and wherein said flexible drive element comprises an endless belt that drives said lower end of said door panel downwardly when said motor is driven in one direction, and drives said lower end of said door panel upwardly when said motor is driven in the opposite direction.

2. An overhead door as claimed in claim 1, wherein said door panel includes:

a flexible panel adapted to be wound onto said roll member when the door is open and unwound from said roll member when the door is closed, said flexible panel including a free end; and a bottom member connected to said free end of said flexible panel and forming said lower end of said door panel, said motor being drivingly connected to said bottom member.

3. An overhead door as claimed in claim 1, wherein said flexible drive element follows a circuitous path that extends downwardly from said lower end of said door panel, upwardly above said lower end, then downwardly to said lower end to thereby form a loop drive system.

4. An overhead door as claimed in claim 2, further comprising means for counteracting the weights of said flexible panel and said bottom member.

5. An overhead door as claimed in claim 4, wherein said counteracting means includes a biasing weight connected to said roll member to rotatably bias said roll member to rotate in a winding direction.

6. A roll-up door comprising:

a roll member rotatably mounted;

a biasing mechanism providing the sole means for biasing said roll member in a winding rotational direction;

a flexible panel adapted to be wound onto said roll member in response to rotation of said roll in said winding direction to open the door and unwound from said roll member when the door is closed, said flexible panel including a free end;

a motor drivingly connected to said free end of said flexible panel to selectively drive said free end downwardly; and means for drivingly connecting said motor to said free end of said flexible panel to drive said flexible panel downwardly in response to actuation of said motor;

wherein said connecting means comprises a flexible drive element driven by said motor and connected to said free end of said flexible panel, and wherein said flexible drive element comprises an endless belt that drives said free end of said flexible panel downwardly when said motor is driven in one direction, and drives said free end of said flexible panel upwardly when said motor is driven in the opposite direction.

7. An overhead door as claimed in claim 6, further comprising a bottom member secured to said free end and being drivingly connected to said motor.

8. An overhead door as claimed in claim 6, wherein said flexible drive element follows a circuitous path that extends downwardly from said free end of said flexible panel, upwardly above said free end, then downwardly to said free end to thereby form a loop drive system.

9. An overhead door as claimed in claim 6, further comprising means for counteracting the weight of said flexible panel.

10. An overhead door as claimed in claim 9, wherein said counteracting means includes a biasing weight connected to said roll member to rotatably bias said roll member to rotate in a winding direction.

* * * * *